United States Patent [19]

Peterson, Jr.

[11] 4,444,276

[45] Apr. 24, 1984

[54] UNDERGROUND RADIAL PIPE NETWORK

[75] Inventor: Dewey L. Peterson, Jr., Tulsa, Okla.

[73] Assignee: Cities Service Company, Tulsa, Okla.

[21] Appl. No.: 209,567

[22] Filed: Nov. 24, 1980

[51] Int. Cl.[3] ..... E21B 7/04

[52] U.S. Cl. ..... 175/61; 175/67

[58] Field of Search ..... 175/61, 67, 65, 73–78; 166/222, 223; 299/17

[56] References Cited

U.S. PATENT DOCUMENTS

| | | | |
|---|---|---|---|
| 2,251,916 | 8/1941 | Cross | 299/17 |
| 3,400,980 | 9/1968 | Dahms et al. | 166/223 |
| 3,797,576 | 3/1974 | Azalbert et al. | 175/75 |
| 4,109,715 | 8/1978 | Adamson | 299/17 |
| 4,303,134 | 12/1981 | Dismukes | 175/61 |

*Primary Examiner*—William F. Pate, III

*Attorney, Agent, or Firm*—George L. Rushton

[57] ABSTRACT

The network, useful in conducting fluids to underground sites, is an assembly of flexible pipes or tubes, suspended from and connected to a drill pipe. The flexible pipes, assembled in a bundle, are spring biased to flare outwardly in an arcuate manner when a releasable cap on the distal end of the bundle is removed. The assembled bundle is inserted into and lowered down a bore hole. When the cap is released, the pipes flare radially and outwardly. Fluid, pumped into and through the assembly, can be directed into the underground formation for various purposes.

3 Claims, 11 Drawing Figures

RELEASED GUIDE MANDREL

ASSEMBLED GUIDE MANDREL

RELEASED GUIDE MANDREL

FLEXIBLE TUBE PLACEMENT

ADAPTER MANIFOLD
(TOP VIEW)

ADAPTER MANIFOLD
(BOTTOM VIEW)

ADAPTER MANIFOLD
(SIDE VIEW)

TOP VIEW
TUBE GUIDE HEAD
(RELAXED STATE) BEFORE ASSEMBLY

SIDE VIEW
TUBE GUIDE HEAD
(RELAXED STATE) BEFORE ASSEMBLY

END CAP
(TOP VIEW)

END CAP
(BOTTOM VIEW)

END CAP
(SIDE VIEW)

UNDERGROUND RADIAL PIPE NETWORK

BACKGROUND OF THE INVENTION

The present invention relates to a network of piping. More particularly, it relates to an expansible-type piping network insertible into an underground well or cavity and to a method of using the piping network. Specific embodiments of the invention are directed to the expansion, extension, enlargement, or development of the lower section of a borehole or drilled well. The invention can be utilized in those areas of petroleum technology related to unconsolidated or loosely consolidated hydrocarbon-bearing formations, such as heavy oil deposits or tar sands formations. The invention can also be utilized in the solution mining of soluble material. In another aspect, the invention can also be used to install a radial pipe system in a mined-out or hydraulic cut-out slot or cavern. Primarily, the invention is useful when the hydrocarbon of the hydrocarbon-bearing formation has a high viscosity at normal reservoir conditions. These conditions are related to a minimum or low effective reservoir permeability. In a further aspect, the invention has usage to extend the effective well bore radius for more efficient drainage or injection, regardless of the hydrocarbon viscosity or formation permeability whenever there is excessive resistance to flow from any type blockage at the well bore.

The invention can be used to extend the effective drilled well bore radius through a method of inserting, perpendicularly from the well bore, a radial network of pipes into a relatively unconsolidated formation. After the pipes have been inserted into the formation, the pipe network can be used to carry fluids into the formation, for stimulation of production or development of channels of communication for injection and flow.

The invention has several objects, such as:

- installation of a horizontal network of pipes in a formation through a single vertical bore hole.
- changing the generally vertical orientation of tubing in a bore hole to a generally horizontal orientation of the tubing in the formation outside the bore hole.
- extending or enlarging the effective area or size of a drilled well or bore hole.
- establishment of inter-well fluid communication.
- processing of single cell production wells, in a "huff and puff" manner.
- placing a tubing-diverting tube guide in a vertical bore hole.
- a release arrangement whereby a tubing-diverting tube guide can operate to change the direction of tubing, from generally vertical in a bore hole to generally horizontal outside the bore hole.

These objects, together with other objects and advantages which will become subsequently apparent, reside in the details of construction and operation as more fully described and claimed hereinafter.

SUMMARY OF THE INVENTION

My invention for the apparatus involved in the radial pipe network for underground use and the method of using this network fulfills the above-mentioned objects of the invention.

The apparatus itself is typically suspended from and connected to a tube or conduit, such as a drill string or drill pipe. An adapter manifold is used to connect the drill pipe with the remainder of the radial pipe network, and this manifold, or housing, is generally cylindrical in nature. On the upper horizontal surface of the manifold, there is an outlet for connecting the manifold with the drill string or drill pipe. The lower horizontal surface of the manifold has a plurality of outlets. The internal structure of the manifold has passageways allowing the flow of fluid from the drill pipe to the outlets of the manifold.

Attached to and suspending from the lower horizontal surface of the manifold is a plurality of flexible tubes, these tubes being individually fastened to the outlets and generally extending downwardly from the manifold.

At some distance from the lower horizontal surface of the manifold, these tubes enter and are surrounded by a tube guide head. This guide head is generally circular in nature, is horizontally oriented, and has a plurality of openings to accomodate individually the tubes. On the lower surface of the cylindrical tube guide head are attached tube guides. These tube guides extend downwardly from the lower surface of the tube guide head and receive, divert, and direct the tubes leaving the tube guide head. The tube guides, in a released position, are arcuately shaped, thus projecting outwardly from the normal size of the manifold-tube bundle-tube guide head apparatus. In an assembled position, under tension, the tube guides are positioned to have their individual longitudinal axes parallel to the previously described axis of the apparatus. The tube guides and tube guide head, although receiving and guiding the ultimate direction of the flexible tubes, are not rigidly attached to the tubes but surround or enclose the individual tubes, with the tube guides and tube guide head allowing movement of the tubes into and through the head and guides.

At the distal end of the flexible tubes, which extend past the distal ends of the tube guides, is an end cap. This cap, generally in the form of a hollow hemisphere, has the spherical portion of the cap extending downwardly relative to the distal ends of the flexible tubes. A keeper plate, generally circular in nature, is mounted on and covers the open portion of the hemisphere. This keeper plate has individual openings to receive the distal ends of the individual tubes extending from the tube guides. The end cap has an outlet in its spherical portion, opposite the keeper plate.

The above-described pipe network receives fluid from the drill pipe and divides and directs the fluid flow into and through the individual flexible tubes. When the tube guides are in the released position, the fluid flow through the flexible tubes is directed radially outward from the long axis of the tube network. When the tube guides are in the closed, or compressed, position, the fluid flow through the individual flexible tubes is directed into and through the outlet in the lower portion of the end cap.

The method of utilizing this pipe network comprises the steps of:

(a) moving a fluid stream from a conduit, such as a drill pipe, into a pipe manifold attached to the lower end of the conduit (drill pipe), (b) allowing the fluid to flow from the manifold into individual flexible tubes attached to the manifold, in which the longitudinal axes of the flexible tubes are generally parallel, (c) enclosing, guiding, and directing the flexible pipes through a tube guide head and associated tube guides, wherein the arcuate tube guides are connected to the lower surface of the tube guide head, such that the ultimate direction of the fluid flow is governed by the ultimate disposition of the tube guides.

(d) arranging the tube guides, and associated flexible tubes enclosed therein, in a closed position, wherein the tube guides are in a compressed orientation in a tube bundle, with the distal ends of the flexible tubes extending through and beyond the distal ends of the tube guides.

(e) allowing the fluid flow into, through, and out of an end cap, generally hemispherical in nature, that surrounds and encloses the distal ends of the tubes of the tube bundle, with an outlet in the lower portion of the end cap offering an outlet for the fluid flow, and (f) allowing a different direction of flow from the flexible tubes when the end cap is removed, thus placing the tube bundle in the released, or open, position, wherein the flexible tubes, oriented by the arcuately-shaped tube guides, direct the fluid flow in a radial pattern and direction that is generally normal to the longitudinal axis of the tube network, thus allowing a generally vertically-directed fluid flow to be diverted into a generally horizontally-directed flow.

The above-described apparatus, and method of operation, offer a pipe network that ultimately can direct fluid flow in a generally horizontal direction, with the network being introduced into a subterranean formation through a single vertical bore hole. The generally vertical orientation of the tubing in the tube bundle can be directed to a generally horizontal orientation of the tubing when the assembled network is moved through and out of the vertical bore hole. By using the above-described apparatus and method in a plurality of locations, several wells with associated bore holes can be formed, and inter-well communication can be established. If only a single bore hole and single tube network is used, a single well can be processed, in a "huff and puff" manner, using the alternate inflow and outflow of processing fluid through the drill string and pipe network. The apparatus and method of operation also involve a release arrangement whereby the tubing network can be held in one orientation by an end cap and then can assume a different orientation when the end cap is removed. This release arrangement allows a change of orientation of the flexible tubes from generally vertical to generally horizontal, thus allowing the fluid flow to spread horizontally throughout a greater expanse of underground formation than would be allowable when using only a normally vertical tubing orientation.

DETAILED DESCRIPTION OF THE INVENTION

Since, in one embodiment of the invention, this underground radial pipe network is to be inserted into an underground formation via a well shaft or borehole, the overall diameter of the bundle is such that the assembled bundle can freely travel up and down the bore hole, moved by the drill string or drill pipe. Depending on the depth of the underground formation to be investigated, the overall diameter of the assembled tube bundle can vary from about 4 to about 12 inches. An exemplary tube bundle will have an outside or overall diameter of about 6½ inches.

For examples of bundle sizes at various formation depths, these values are given:

| Formation Depth | Bundle Size (OD) |
|---|---|
| About 500′ | 8¾″ |
| About 1500′ | 7″ |
| About 3000′ | 7″ |

These measurements are adapted from known petroleum drilling practices.

Figure 1:
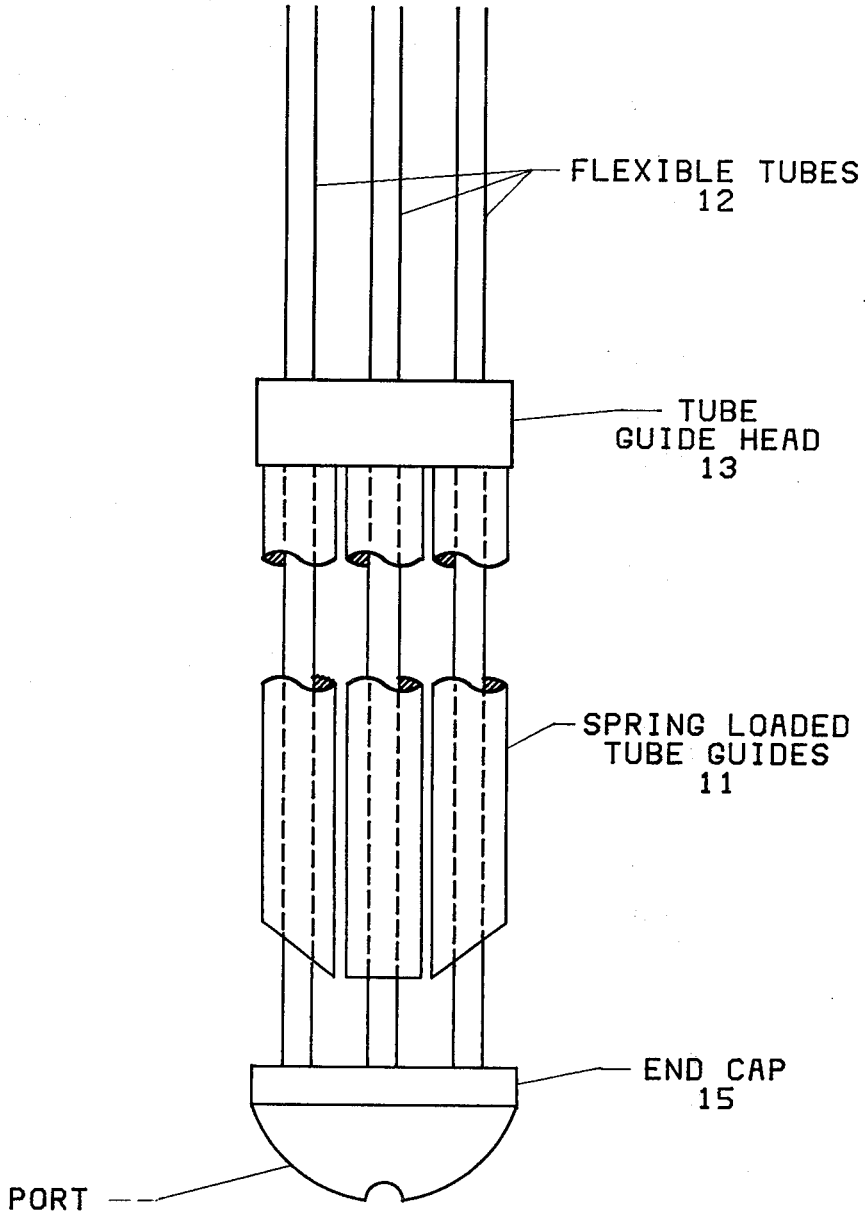
FIG. 1 shows a side view of the lower portion of the pipe network, with the tube guides in a closed, or compressed, position.
Figure 2:
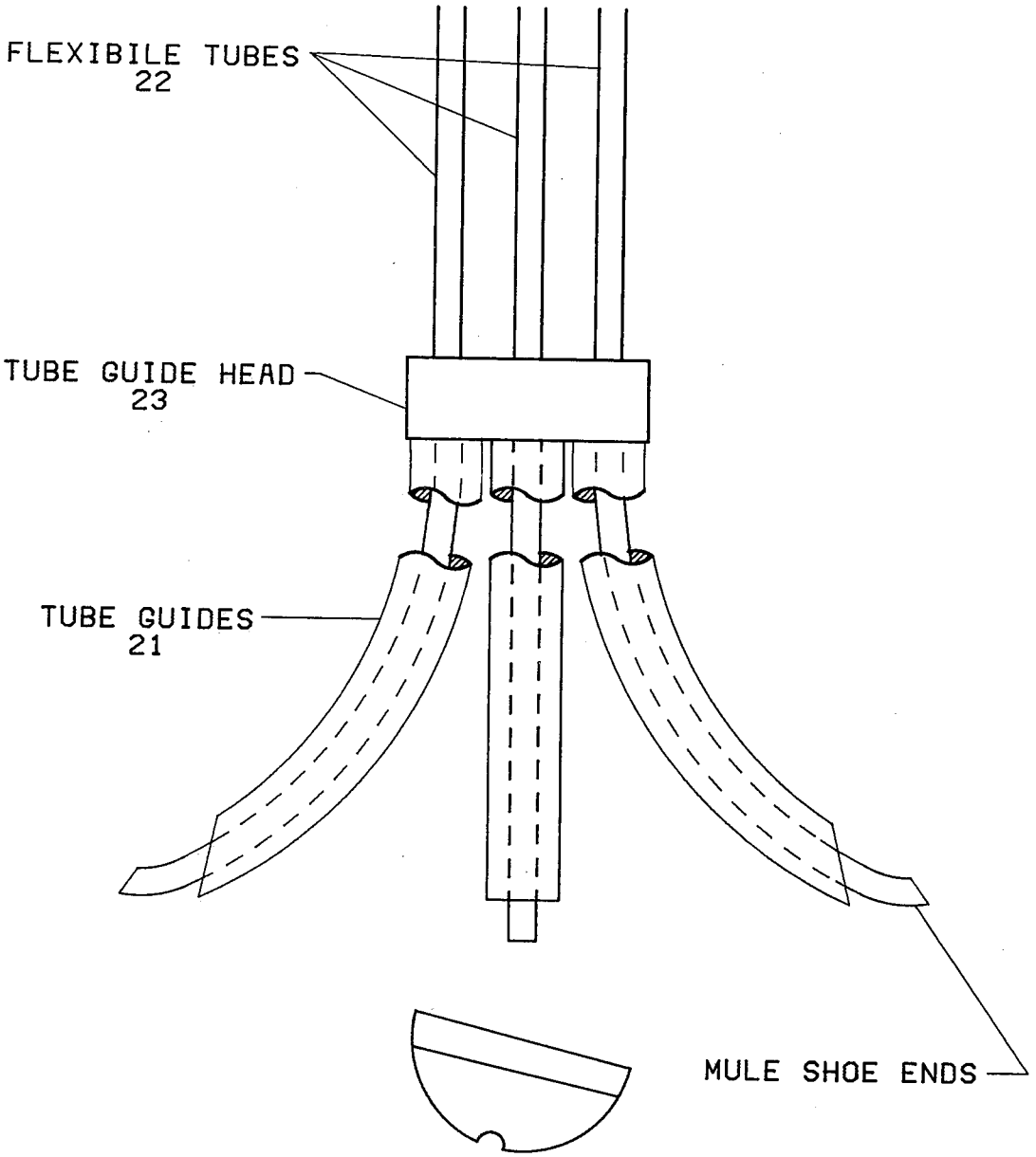
FIG. 2 shows a side view of the lower portion of the pipe network, with the end cap released and the arcuately-shaped tube guides in a released, or open, position.

FIGS. 1 and 2 illustrate the guide mandrel in assembled and released positions.

Figure 3:
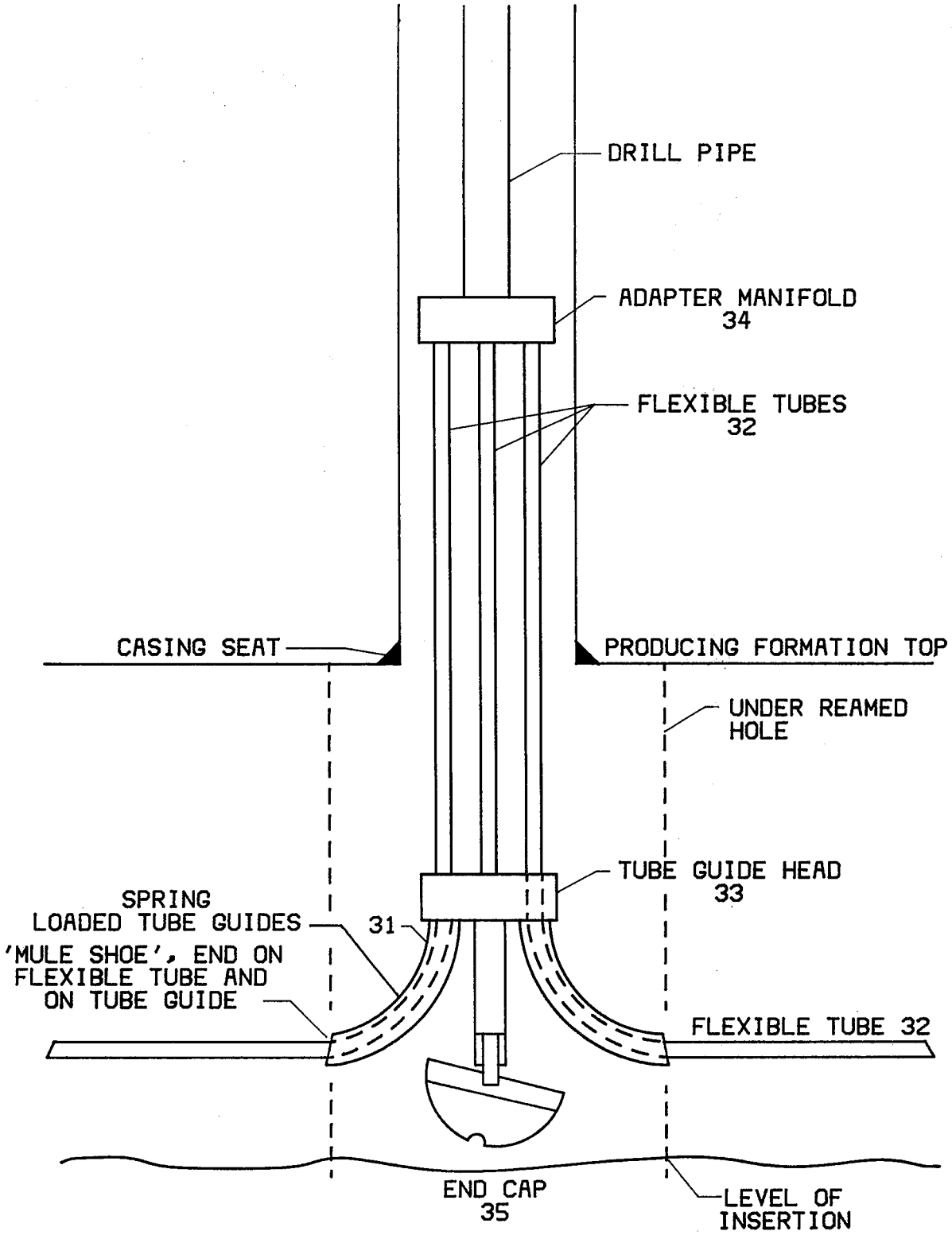
FIG. 3 shows a side view of one application of the pipe network, showing the drill string, the portions of the pipe network, the formation, and the tube guides in a released portion, with the flexible tubes entering the unconsolidated formation.
Figure 4:
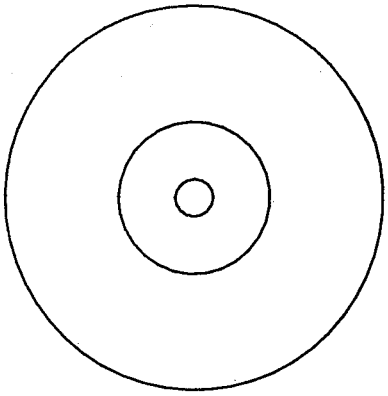
FIGS. 4, 5, and 6 show top, bottom, and side views, respectively, of the adapter manifold.
Figure 5:
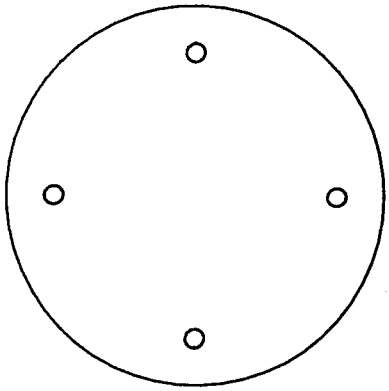
Figure 6:
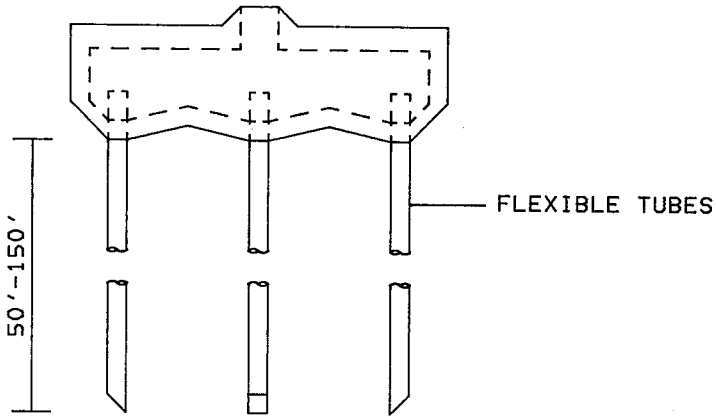
Figure 7:
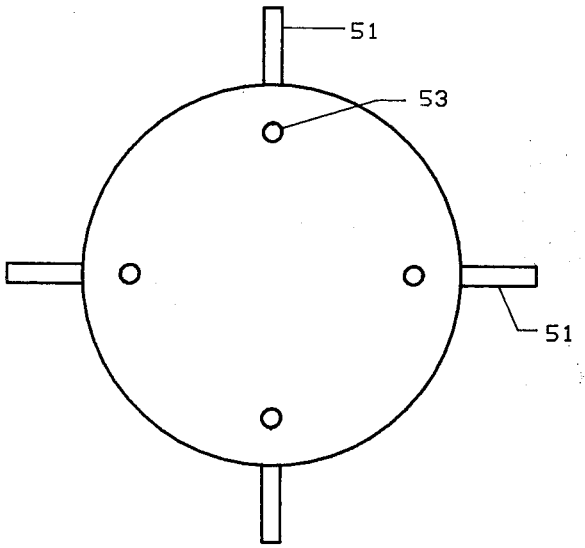
FIGS. 7 and 8 show top and side views of the tube guide head and tube guides in a released, or open, position.
Figure 8:
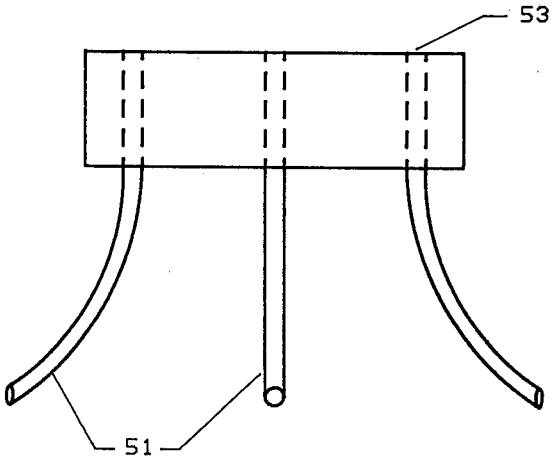

The number of flexible tubes 12, fixed to and depending from the adapter manifold and movable into, through, and out of the tube guide head and tube guides, varies, broadly, in number from about 2 to about 8, depending on the size of the bore hole and the usable size of each flexible tube. Although FIGS. 1–11 illustrate the use of 4 flexible tubes, these figures merely illustrate one embodiment of the invention. The overall length of the flexible tubes, from the adapter manifold to the distal ends, equals the desired radius of operation of the pipe network when it is extended for operation in the subterranean formation. Broadly, this length can vary from about 50 feet to about 150 feet. In FIGS. 7 and 8, the tube guides 51 can have an inner diameter of about 1–1½, based on a "bundle" having 4 tubes. In FIG. 3, flexible tubes 32, preferably made of medium tensile steel, have a range of ¾–1¼″ OD, so that they are movable through the tube guides 31, which are made of spring steel. The adapter manifold 34 (FIGS. 3 and 4), the tube guide head (FIGS. 7 and 8), and the end cap (FIGS. 9, 10, and 11) are made of weldable mild steel. The drill string and borehole casing are well-known in the drilling art and need not be discussed here.

Figure 9:
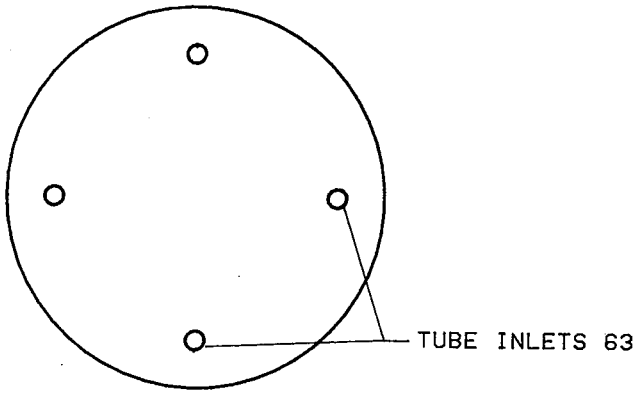
FIGS. 9, 10 and 11 show top, bottom, and side views of the end cap.
Figure 10:
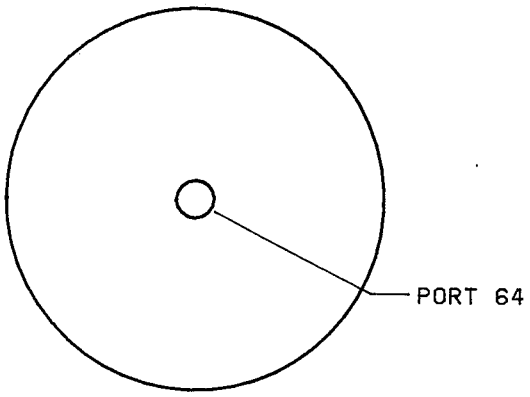
Figure 11:
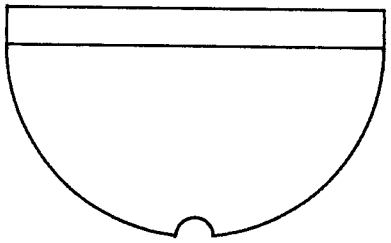

As noted in FIGS. 1, 2, and 3, the distal ends of flexible tubes 32 can be cut at a 45° angle ("mule-shoed") to act as a sled in initiating the horizontal travel after receiving the bending moment from tube guides 31. As noted in the figures, the flexible tubes, depending from the adapter manifold 34, are inserted in a spring-loaded guide mandrel made up of a tube guide head 13, and attached larger tubes or flat spring leaves, which act as tube guides 11. As noted in FIGS. 1 and 2, the relaxed, or open, position of the tube guides or spring leaves are in the general shape of about 90° arcs. The proximal end of each leaf or guide tube is fixed in a solid metal mandrel or tube guide head 53 (FIGS. 7 and 8). The distal ends of the leaves or tube guides, when in open position, open outwardly from the general longitudinal axis of the assembly, like an upside-down umbrella. In an assembled, or closed, position the spring leaves or tube guides are compressed, and flexible tubes 12 pass into, through, and out of the tube guides 11 and into the openings in the plate covering the upper portion of the end cap (FIG. 1). In FIG. 9, these tube inlets 63 are honed and provided with seals to give a pressure seal with the flexible tubes. A port, or outlet, 64 is found in the hemispherical portion of the end cap most distant from the plate.

In the operation of this radial pipe network, the flexible tubes, fixed to the lower portion of the adapter manifold 34, are passed through openings 53 (FIGS. 7 and 8), through tube guides 51, and into the end cap (FIG. 9). This means that the tube guides 11 and the flexible tubes 12 are compressed into the configuration shown in FIG. 1, with the distal ends of the flexible tubes projecting through the distal ends of the tube guides into the end cap 15. This end cap acts as a retainer for the ends of the flexible tubes, keeping the tube bundle in the assembled, or closed, position (FIG. 1).

The assembled tube bundle, with end cap in place, is attached to the distal end of the drill pipe and lowered through the well bore to the desired place in the underground formation. If necessary or desirable, fluid can be pumped down the drill pipe, through the tube bundle, and out the port in the end cap, to provide a form of jet action to assist in lowering the assembled tube bundle through the material in the formation,, either in the loose, unconsolidated stage or in a slurry stage.

At the desired depth, a steel ball is dropped into the drill pipe and travels through the tubing network downwardly until it is located in the end cap, where it seals the outlet port. Additional pump pressure applied at this time will force fluid through the tube assembly and into the end cap and will overcome the spring resistance holding the tubes in the end cap, removing the end cap and allowing the spring leaves or guide tubes to flare outwardly, assuming a position such as shown in FIG. 2.

The tube guides, having lengths of approximately 4–6 feet, have a relaxed arcuate shape of approximately a 90° arc. When the spring tension held by the end cap is released, these tube guides, with enclosed flexible tubes, assume the released position. By lowering the principal tubing string, with continued circulation for jetting at the ends of the flexible tubes, the flexible tubes can be pushed and washed out into the unconsolidated formation (or slurry). The limit of the tubing travel and the extent of the flexible tube penetration occurs when the adapter manifold 34 reaches the tube guide head 33 of the guide mandrel. Drill collars and bumper jars can also be used to help drive the tubes into place, if necessary. Sonic vibrations can also be applied to the tubing string to help effect final tube placement.

After placement, treating fluids can then be pumped through the drill pipe and radial flexible tube network to perform the desired results. In well casing of sufficient size, a second string of tubing can be run to recover production from a different level in the well bore.

The treating fluid pumped through the radial tube network is distributed throughout the horizontally-placed flexible tubes. For example, orifice plugs limiting the flow through the distal end of each flexible tube can be used in conjunction with predrilled holes in the horizontally exposed portions of the flexible tubes. These predrilled holes can be filled with temporary metal plugs, such as magnesium plugs. To make the holes available for the distribution of the processing fluid, a preliminary flow of a plug-removing liquid, such as dilute acid, can be pumped through the radial tube network, thus making distribution of the ultimate processing fluid more efficient through the exposed portions of the flexible tubes.

In one embodiment of the operation of this radial tube network, preliminary work can be done in the underground formation to form a cavity around the axis of the well bore. Other devices, not shown, can be used to cut away the unconsolidated formation by jet action of fluids, such as water, to form a slurry. When the cavity, formed by the jetting action, is filled with slurry, the drill string connected to the jetting apparatus can be withdrawn, and the radial tube network can be connected to the drill pipe and lowered, as described above. When the processing stage is completed, the flexible tubes can be withdrawn by pulling with the drill pipe. The released guide mandrel will be left in place at the bottom of the bore hole. If the flexible tubes are stuck there, various cutting devices, known in the petroleum drilling industry, can be used to separate the radial pipe network at the adapter manifold, leaving those portions below in the underground formation.

We claim:

1. An underground radial pipe network comprising, in a related sequence, an adapter manifold, cylindrically shaped, having an upper horizontal surface having an outlet, useful for connecting the manifold with drill pipe, and a lower horizontal surface attached to the hollow cylindrical shell of the manifold and having a plurality of outlets, the manifold having internal passageways allowing fluid passage from the drill pipe to the outlets, a plurality of tubes, flexible in nature, fastened individually to the outlets of the lower horizontal surface of the manifold, and extending generally downwardly from the manifold, a tube guide head, circular in shape, horizontally placed, and having a plurality of openings to accomodate individually the flexible tubes extending from the manifold, with tube guides attached, on the lower surface of the tube guide head, to said openings, to receive the tubes extending from the manifold, said tube guides being arcuately shaped when in a released position and relatively straight when in an assembled position, the tube guides and the tube guide head surrounding and being free to move along the flexible tubes extending from the manifold, and an end cap, generally in the form of a hollow hemisphere with the spherical portion extending downwardly relative to the tube guide head, the cap having a keeper plate mounted on and covering the open portion of the hemisphere, with the keeper plate having individual openings to receive the distal ends of the individual flexible tubes extending from the distal ends of the tube guides, and with the end cap having an outlet opposite the keeper plate, wherein the network has an assembled position in which the end cap receives and holds the tubes, in a vertical tube bundle array extending downwardly from the adapter manifold, and a released position, in which the end cap is removed, allowing the tubes and the surrounding tube guides to assume arcuate shapes.

2. The network of claim 1, wherein a. the diameter of the adapter manifold varies from about 4" (O.D.) to about 12" (O.D.), b. the number of flexible tubes, and related outlets, connected to the lower manifold surface, tube guide head, and keeper plate, vary from 2 to 8, with the individual tubes varying in size from about ¾" to about 1¼" (O. D.), with the related outlets being large enough to accomodate the associated tubes, c. the flexible tubes, fastened to the lower horizontal surface of the manifold and extending through the keeper plate, vary in length from about 50' to about 150'.

d. the tube guides, equal in number to the flexible tubes, have a length of about 6', a diameter suitable to accomodate the tubes, and an arcuate shape of up to about 90°, in a released position, e. the tube guide plate and the end cap each has a diameter similar to that of the adapter manifold, and f. the port in the end cap is an opening varying from about ¼" to about ½" in diameter.

3. A method of extending or enlarging the effective area of a drilled well or of a vertical bore hole comprising the steps of:

a. assembling a plurality of flexible tubes into a bundle, b. spring biasing (or spring loading) said tubes individually so that extremities of said tubes tend to flare or bend outwardly from a first position defining an assembled bundle to a second position defining a curve, c. releasably retaining said tubes in said first position, d. inserting the bundle of tubes into a bore hole, and e. releasing said tubes so that said extremities assume said second position, wherein the tubes of the tube bundle are released from the first assembled position by:

1. inserting a steel ball, of a size sufficient to seal the outlet port of the end cap that maintains the tube bundle in the assembled position, into the tube bundle, 2. allowing the steel ball to gravitate to the lower portion of the end cap, thus sealing the outlet port, and 3. forcing a fluid through the assembly of the tube bundle and into the end cap with sufficient pressure to remove the end cap from contact with the tube bundle, thus allowing the tubes of the tube bundle to assume said second or released position.

* * * * *